US006796315B2

(12) United States Patent
Lu et al.

(10) Patent No.: US 6,796,315 B2
(45) Date of Patent: Sep. 28, 2004

(54) METHOD TO REMOVE PARTICULATE CONTAMINATION FROM A SOLUTION BATH

(75) Inventors: Kuo-Liang Lu, Hsinchu (TW); Wen-Song Tseng, Taichung (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 10/340,119

(22) Filed: Jan. 10, 2003

(65) Prior Publication Data

US 2004/0134513 A1 Jul. 15, 2004

(51) Int. Cl.[7] ..... B08B 3/08; B08B 3/12

(52) U.S. Cl. ..... 134/1.3; 134/1; 134/2; 134/3; 134/26; 134/28; 134/29; 134/902

(58) Field of Search ..... 134/1, 1.3, 2, 3, 134/26, 28, 29, 902

(56) References Cited

U.S. PATENT DOCUMENTS 5,837,662 A * 11/1998 Chai et al. ..... 510/175
6,596,148 B1 * 7/2003 Belongia et al. ..... 205/99
2003/0211427 A1 * 11/2003 Tseng et al. ..... 430/329

* cited by examiner

*Primary Examiner*—Zeinab El-Arini
(74) *Attorney, Agent, or Firm*—Tung & Associates

(57) ABSTRACT

A method of cleaning particulates from a solution bath including at least partially filling a deionized water (DIW) bath for rinsing at least one wafer following chemically cleaning the at least one wafer; rinsing the at least one wafer; transferring the at least one wafer to a downstream process; at least partially draining the DIW from the DIW bath; at least partially filling the DIW bath with a bath cleaning solution; and, applying at least one source of ultrasonic energy to agitate the bath cleaning solution.

22 Claims, 2 Drawing Sheets

METHOD TO REMOVE PARTICULATE CONTAMINATION FROM A SOLUTION BATH

FIELD OF THE INVENTION

This invention generally relates to semiconductor wafer manufacturing and more particularly to methods for cleaning semiconductor manufacturing tools such as a solution bath to remove particulate contamination and maintain a particulate free solution bath to prevent contamination of semiconductor process wafers.

BACKGROUND OF THE INVENTION

In creating a multiple layer (level) semiconductor device on a semiconductor wafer, each layer making up the device may be subjected to one or more deposition processes, for example using chemical vapor deposition (CVD) or physical vapor deposition (PVD), and usually including one or more dry etching processes. A critical condition in semiconductor manufacturing is the absence of particulates on the wafer processing surface, since microscopic particles may interfere with and adversely affect subsequent processing steps leading to device degradation and ultimately semiconductor wafer rejection.

While the wafer cleaning process has been always been a critical step in the semiconductor wafer manufacturing process, ultraclean wafers are becoming even more critical to device integrity. For example, as semiconductor feature sizes decrease, the detrimental affect of particulate contamination increases, requiring removal of ever smaller particles. For example, particles as small as 5 nm may be unacceptable in many semiconductor manufacturing processes. Further, as the number of device layers increase, for example to 5 to 8 layers, there is a corresponding increase in the number of cleaning steps and the potential for device degradation caused by particulate contamination. To adequately meet requirements for ultraclean wafers in ULSI and VLSI the wafer surface must be essentially free of contaminating particles.

Another factor in modern processing technology that increases the incidence of particle contamination is the deposition of carbon doped oxides as IMD layers to achieve dielectric constants of less than about 3.0. The IMD layers are typically deposited by a plasma enhanced CVD (PECVD), low pressure CVD (LPCVD) or high density plasma CVD (HDP-CVD). In these processes, a degree of sputtering occurs as the layer of material is deposited causing a higher degree of particulate contamination as the deposition time increases. In addition, PVD processes are typically used to deposit films of metal, for example barrier/adhesion layers within anisotropically etched features or for metal filling an anisotropically etched feature. PVD processes tend to coat the inner surfaces of the processing chamber with a metal film, flaking off to contaminate a wafer process surface as the metal film increases in thickness and are subjected to cyclic thermal stresses. Other processes that frequently resulting particulate contamination include plasma etching processes where a photoresist layer is etched away during an ashing process. Over time, the buildup of ashing residue within a plasma etching chamber increases the probability that a semiconductor wafer will become contaminated by particulates.

Particulate contamination may cause 'killer defects' resulting in integrated circuit opens or shorts by occluding a portion of a circuit or providing a shorting path between two conductive lines of a circuit.

Typically, to reduce processing times and increase throughput, in prior at processes, ex-situ cleaning processes are performed following particle generating processes such as plasma etching or PECVD film deposition. For example, common particle removal mechanisms which may be exploited, depending on the particle and how it adheres to the surface, include oxidizing degradation and dissolution, physical removal by etching, and electrical repulsion between a particle and the wafer surface.

Standard wafer cleaning processes typically employ a dipping process whereby a plurality (batch) of process wafers are dipped sequentially in a series of solution baths. For example a wafer cleaning process to remove particulate contamination may typically include a first chemical bath followed by a de-ionized water bath followed by a drying bath. Megasonic cleaning process have been used in the prior art in the chemical bath cleaning stage. One limitation of using megasonic agitation for cleaning wafers can be the tendency of detached particulates to reattach due to insufficient agitation. For example megasonic agitation in cleaning wafers including frequencies higher than about 800 kHz is used to minimize wafer pitting caused at lower frequencies. A deionized water (DIW) rinsing step invariably follows the chemical bath cleaning stage to neutralize the etching action by chemicals included in the chemical bath and to remove residual or reattached residual particles. However, a shortcoming of a cleaning process where the chemical bath stage is followed by a DIW rinse, for example DIW bath, and a subsequent drying process, is that the DIW rinsing step alters the zeta potential of the residual particulates favoring accumulation of particulates, particularly organic polymer particulates, on the wafer carrier and the DIW bath surface. Over time, as particulates accumulate, the zeta potential of the particulates in the DIW bath surface changes to favor reattachment to the wafer surface, requiring frequent preventive maintenance cleaning of the DIW bath and wafer carrier to prevent particulate contamination of subsequently processed wafers. Such preventative maintenance cleaning is time consuming and frequently requires costly shutdown of the wafer production line.

There is therefore a need in the semiconductor wafer processing art to provide an improved method for cleaning solution baths used in wafer cleaning processes to reduce preventative maintenance and improve wafer cleaning results.

It is therefore an object of the invention to provide an improved method for cleaning solution baths used in wafer cleaning processes to reduce preventative maintenance and improve wafer cleaning results while overcoming other shortcomings and deficiencies of the prior art.

SUMMARY OF THE INVENTION

To achieve the foregoing and other objects, and in accordance with the purposes of the present invention, as embodied and broadly described herein, the present invention provides a method of cleaning particulates from a solution bath.

In a first embodiment, the method includes at least partially filling a deionized water (DIW) bath for rinsing at least one wafer following chemically cleaning the at least one wafer; rinsing the at least one wafer; transferring the at least one wafer to a downstream process; at least partially draining the DIW from the DIW bath; at least partially filling the DIW bath with a bath cleaning solution; and, applying at least one source of ultrasonic energy to agitate the bath cleaning solution.

These and other embodiments, aspects and features of the invention will be better understood from a detailed description of the preferred embodiments of the invention which are further described below in conjunction with the accompanying Figures.

DETAILED DESCRIPTION OF THE PREFERRED EMBODIMENTS

Although the method of the present invention is explained with reference to, and is particularly advantageously used with a deionized water (DIW) rinsing bath, it will be appreciated that the method of the present invention may be advantageously used with other solution baths, to remove accumulated particulates, particularly organic particulates, to reduce particulate contamination and reduce a preventative maintenance requirement.

Figure 1A:
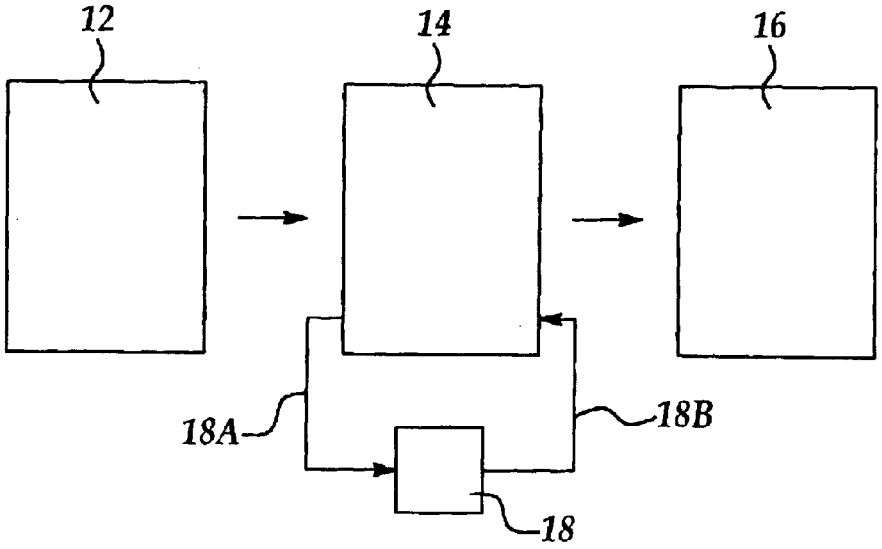
FIG. 1A is an exemplary wafer cleaning process including an embodiment of the bath cleaning process of the present invention.

Referring to FIG. 1A, is shown an exemplary wafer cleaning process including the solution bath cleaning process of the present invention. For example, are shown three cleaning process stations, for example wafer batch process cleaning stations including a chemical cleaning bath stations 12, a DIW rinsing bath station 14 and a drying station 16. For example, the chemical cleaning bath station 12 may include any type of cleaning process known in the art, including dipping a batch of wafers in a chemical solution bath and optionally including a megasonic agitation source. For example, preferably, the chemical cleaning solution may be any chemical cleaning solution, several commonly known to a skilled practitioner in the art.

Figure 1B:
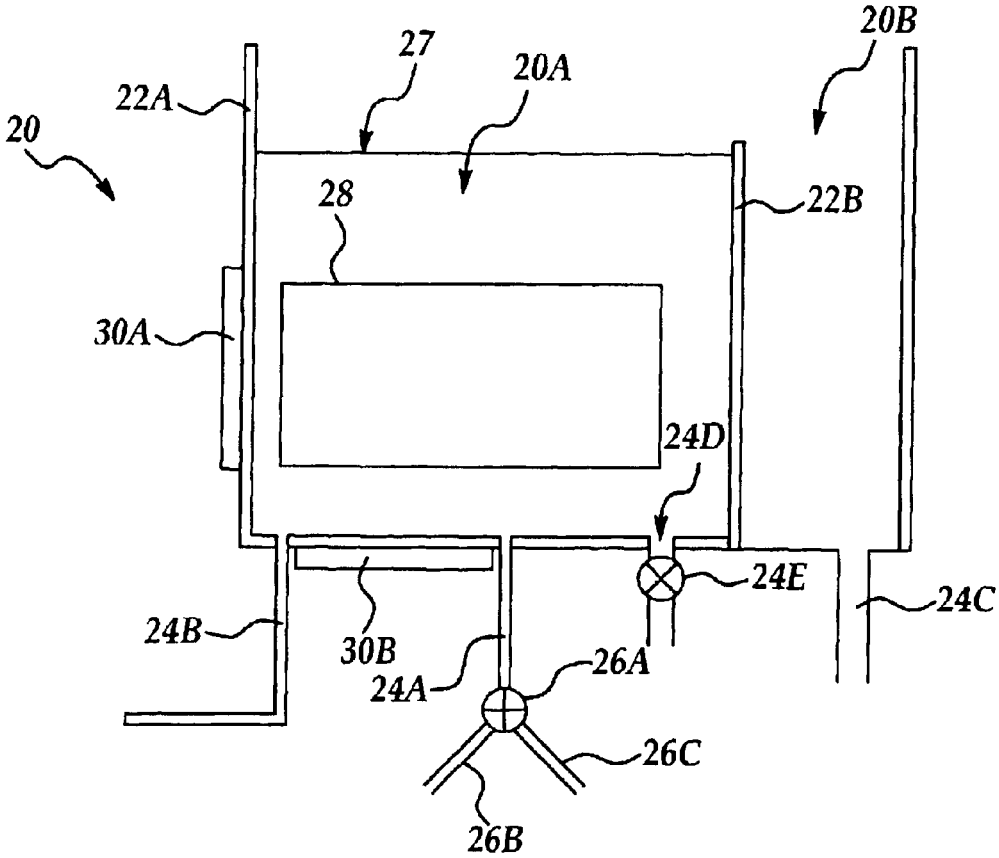
FIG. 1B is an exemplary implementation of the bath cleaning process of the present invention.

Following cleaning of the process wafers at the chemical cleaning bath station 12, a batch of process wafers, preferably held in a conventional wafer carrier, are transferred to the DIW rinse bath station 14. Preferably, the DIW rinse bath station includes a solution bath of deionized water and a DIW bath including at least a DIW supply and drain. For example, referring to FIG. 1B is shown side view of an exemplary DIW bath for implementing the method of the present invention. For example, a single stage overflow bath 20 including a housing 22A, having a wall 22B separating the main bath portion 20A and the overflow portion 20B. It will be appreciated that the DIW bath may have no overflow stage including only the main bath portion 20A or a two stage overflow, for example including a second overflow portion adjacent the first overflow portion, the drain 24C being included in the last overflow stage, e.g., 20B, and preferably including drain e.g., 24D with valve 24E in the main bath portion 20A. A bath solution supply line 24A, for example, for supplying deionized water (DIW) and an optional nitrogen or air supply line 24B for simultaneously creating gas bubbles during a rinsing or cleaning process is supplied to a bottom portion of the main bath portion 20A.

In one embodiment, the solution supply line 24A includes a valve 26A to switch between a DIW supply line e.g., 26B and a bath cleaning solution supply line 26C communicating respectively with a DIW source (not shown) and bath cleaning solution source (not shown). In the rinsing operation, valve 26A is switched to supply DIW during the DIW bath rinsing process to fill the main bath portion 20A, to cover the wafer carrier, e.g., 28 holding wafers (not shown), and optionally to overflow into overflow stage 20B and out drain 24C. An ultrasonic energy source, for example a transducer, is optionally mounted on at least one sidewall e.g., 30A, and/or bottom portion e.g., 30B of the main bath portion 20A for subsequent use in a bath cleaning process according an embodiment of the method of the present invention. It will be appreciated that the DIW bath may include a separate DIW supply line (not shown) to supply DIW to water sprayers (not shown) disposed in an upper portion of main bath portion 20A to simultaneously spray the wafer process surfaces while filling the main bath portion 20A with DIW.

Referring again to FIG. 1A, following the DIW bath rinsing process, the wafers are transferred to a downstream process, for example drying process 16, for example a spin drying process or an isopropyl alcohol (IPA) vapor drying process. Preferably, the wafers are transferred to a second wafer carrier if a wafer carrier is used in the downstream process the first wafer carrier used in DIW rinsing process 14 preferably being returned to be placed in the DIW bath to undergo cleaning in parallel with DIW bath solution cleaning process 18, followed by preparing the rinsing bath station 14 for a subsequent wafer rinsing process as indicated by directional arrows e.g., 18A and 18B.

Referring again to FIG. 1B, in an exemplary operation of an embodiment of the solution bath cleaning process, following the DIW bath rinsing process, valve 24E is opened to drain the DIW bath main bath portion 20A through drain 24D. The valve 24E is then closed and valve 26A switched to the bath cleaning solution supply line 26C to at least partially fill the main bath portion 20A with bath cleaning solution, preferably covering the wafer carrier 28, as indicated by exemplary bath cleaning solution level 27. In one embodiment, the bath cleaning solution is comprises at least ammonium hydroxide ($NH_4OH$), more preferably additionally including hydrogen peroxide ($H_2O_2$) and water ($H_2O$). Preferably the bath cleaning solution includes a volumetric ratio of $NH_4OH$:$H_2O_2$:$H_2O$ of between about 1:1:5 to about 1:4:50. Alternatively, the bath cleaning solution may be formed in-situ by separately supplying the $NH_4OH$, $H_2O_2$, and $H_2O$ to the DIW water bath. A stronger bath cleaning solution, e.g., 1:1:5 is preferred since organic particles are more readily dissolved. Preferably, the overall wafer cleaning and rinsing process, e.g., 12 and 14, is one that primarily produces organic particulates. However, it will be appreciated that the method of the present invention may be used to clean solution baths including metal particles, for example the DIW bath cleaning solution selected from SC-2 (HCl, H2O2,H2O) piranha (H2SO4, H2O2,H2O), and DHF (HF, H2O) solutions to remove metal particulates from a DIW cleaning bath.

During or following adding the bath cleaning solution to the DIW bath main portion 20A, an ultrasonic source of agitation, e.g., 30A and or 30B is supplied to the bath cleaning solution. The ultrasonic source of energy preferably includes a frequency range of about 10 kHz to about 1200 kHz. It will be appreciated that a megasonic transducer producing megasonic frequencies of about 800 to 1200 kHz may optionally be used but is not necessary to the practice of the present invention. For example, in prior art wafer cleaning processes, higher megasonic frequencies, for example greater than about 800 kHz are used to prevent pitting of wafer surfaces caused at lower frequencies. According to an embodiment of the present invention, the ultrasonic cleaning process includes lower ultrasonic frequencies, for example less than about 800 kHz, including less than about 100 kHz since wafer pitting is not a limiting consideration. Further, ultrasonic transducers including megasonic transducers may be mounted anywhere on the outside of the bath walls to transfer ultrasonic energy to the bath cleaning solution including the bottom portion of the DIW bath since it is not necessary to direct the ultrasonic waves parallel to the process wafers. Further, the ultrasonic source may be at least partially immersed into the bath cleaning solution. In one embodiment, lower ultrasonic frequencies less than about 800 kHz are preferred since such frequencies are more efficient at breaking up larger organic residual particles which speeds their dissolution in the bath cleaning solution. For example, in thick film photoresist processes relatively large flakes of the photoresist may be dislodged into the bath cleaning solution making the use of lower frequencies more efficient to use in the bath cleaning process. In another embodiment, more than one ultrasonic transducer is used to agitate the bath cleaning solution, for example one or more transducers operating at less than about 800 kHz e.g., 30B placed on a bottom portion of the main bath portion 20A in energy transfer relationship with the cleaning solution and one or more transducers operating at megasonic frequencies greater than about 800 kHz e.g., 30A, for example placed on the outside wall of the main bath portion 20A. It will be appreciated that the arrangement of the ultrasonic transducers, e.g., 30A and 30B may be reversed with respect to one another.

Preferably, the ultrasonic solution bath cleaning process is carried for a sufficient period of time to substantially dissolve residual organic particles present in the DIW bath and the wafer carrier if included in the DIW bath. Preferably, the ultrasonic solution bath cleaning process is carried out following a predetermined number of DIW bath rinsing processes, for example at least when the particulate zeta potential is such that particles reattach to wafer process surfaces. More preferably, the ultrasonic solution bath cleaning process is carried out following every DIW bath rinsing process. Further, the bath cleaning solution is preferably drained and recycled following the ultrasonic solution bath cleaning process.

Figure 2:
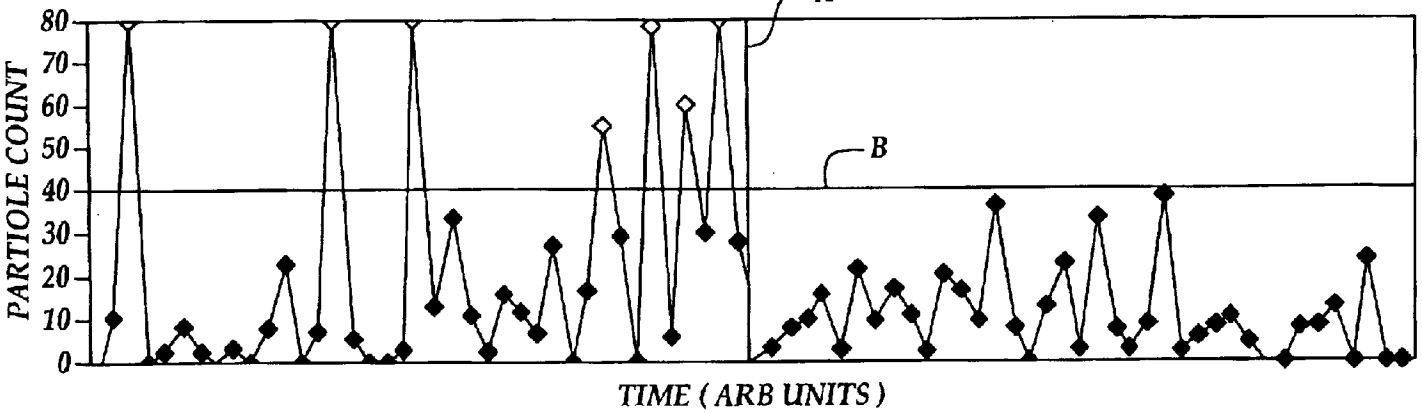
FIG. 2 are wafer particle count results showing results before and following implementation of an embodiment of the present invention.

For example, referring to FIG. 2 is shown exemplary wafer particle count data shown on the vertical axis collected by a conventional optical particle counting method performed on wafer process surfaces following a wafer cleaning process. On the horizontal axis is represented sequentially periodic particle count results taken on about a daily basis shown as arbitrary time units. The wafer cleaning process without the ultrasonic DIW bath cleaning process is shown to the left of line A. To the right of line A, are shown wafer particle count results following implementation of the ultrasonic DIW solution bath cleaning process according to an embodiment of the present invention. Particle count results below about 40, or line B, are considered within acceptable wafer production specifications. It is clearly seen to the right of line A that following implementation of the ultrasonic DIW bath cleaning process, the wafer particle count results are significantly improved, all below 40, resulting in an improved wafer cleaning process, for example with a zero failure rate. Further, preventative maintenance to periodically clean the solution bath according to prior art processes requiring production line shutdowns or delays is avoided, thereby improving wafer throughput.

Figure 3:
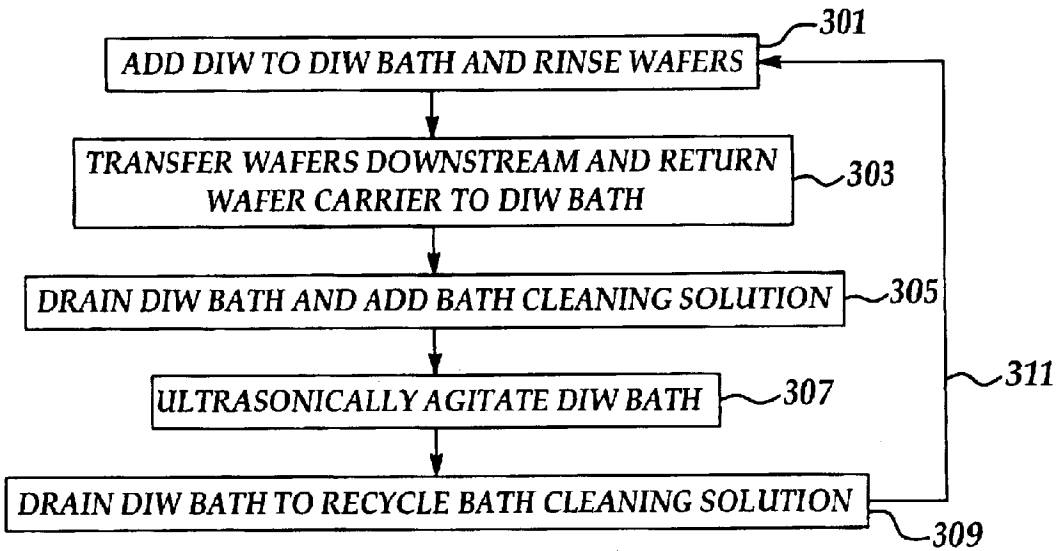
FIG. 3 is a process flow diagram including several embodiments of the present invention.

Referring to FIG. 3 is a process flow diagram including several embodiments of the present invention. In process 301, DIW is added to at least partially fill a DIW bath and a wafer rinsing process is carried out following a wafer cleaning process, for example including organic residues. In process 303, process wafers are transferred to a downstream process and the wafer carrier returned to the DIW bath. In process 305, the DIW bath is drained and the DIW bath cleaning solution is added to the DIW bath according to preferred embodiments. In process 307, the bath cleaning solution is ultrasonically agitated according to preferred embodiments for a preferred period of time. In process 309, the bath cleaning solution is drained and optionally recycled. As indicated by process directional arrow 311, the processes 301 through 309 are repeated at predetermined time periods.

The preferred embodiments, aspects, and features of the invention having been described, it will be apparent to those skilled in the art that numerous variations, modifications, and substitutions may be made without departing from the spirit of the invention as disclosed and further claimed below.

What is claimed is:

1. A method of reducing wafer particulate contamination in a wafer rinsing process comprising the steps of:

a) at least partially filling a rinsing bath apparatus with a rinsing solution for rinsing at least one wafer following chemically cleaning the at least one wafer;

b) rinsing the at least one wafer;

c) transferring the at least one wafer to a downstream process;

d) at least partially draining the rinsing solution from the rinsing bath apparatus;

e) at least partially filling the rinsing bath apparatus with a bath cleaning solution;

f) applying at least one source of ultrasonic energy to agitate the bath cleaning solution;

g) removing the bath cleaning solution; and, repeating steps a) and b).

2. The method of claim 1, wherein the bath cleaning solution comprises ammonium hydroxide ($NH_4OH$) hydrogen peroxide ($H_2O_2$), and deionized water ($H_2O$).

3. The method of claim 2, wherein the bath cleaning solution further comprises a volumetric ratio of $NH_4OH:H_2O_2:H_2O$ of from about 1:1:5 to about 1:4:50.

4. The method of claim 1, wherein the bath cleaning solution comprises a member selected from the group of sulfuric acid and hydrochloric acid, and hydrofluoric acid.

5. The method of claim 1, wherein a wafer carrier holding the at least one wafer is at least partially immersed in the bath cleaning solution prior to carrying out step e).

6. The method of claim 1, wherein step f) comprises at least partial immersion of the at least one ultrasonic energy source into the bath cleaning solution.

7. The method of claim 1, wherein step f) comprises the at least one ultrasonic energy source mounted outside the rinsing bath apparatus in ultrasonic energy transfer relationship with the bath cleaning solution.

8. The method of claim 7, wherein the at least one ultrasonic energy source is mounted on at least one of a bottom portion or wall of the rinsing bath apparatus.

9. The method of claim 1, further comprising repeating steps d) through g) on a periodic basis.

10. The method of claim 1, wherein the step of applying comprises at least one ultrasonic energy source comprising ultrasonic frequencies of about 10 kHz to about 1200 kHz.

11. The method of claim 1, wherein the rinsing bath solution consists essentially of deionized water.

12. A method of cleaning particulates from a rinsing bath apparatus to reduce particulate contamination of a wafer in a wafer rinsing process comprising the steps of:

at least partially filling a rinsing bath apparatus with a bath cleaning solution comprising ammonium hydroxide ($NH_4OH$), hydrogen peroxide ($H_2O_2$), and deionized water ($H_2O$);

applying at least one source of ultrasonic energy to agitate the bath cleaning solution; and, removing the bath cleaning solution.

13. The method of claim 12, wherein the bath cleaning solution further comprises a volumetric ratio of $NH_4OH:H_2O_2:H_2O$ of from about 1:1:5 to about 1:4:50.

14. The method of claim 12, wherein the rinsing bath apparatus comprises residual organic particulates and the step of applying is carried out for a sufficient period of time to at least partially dissolve the residual organic particulates.

15. The method of claim 12, wherein an empty wafer carrier is at least partially immersed in the bath cleaning solution prior to carrying out the step of applying.

16. The method of claim 12, wherein the step of applying comprises at least one ultrasonic energy source comprising megasonic frequencies of about 800 kHz to about 1200 kHz.

17. The method of claim 12, wherein the step of applying comprises at least one ultrasonic energy source comprising ultrasonic frequencies of less than about 800 kHz.

18. The method of claim 12, wherein the step of applying comprises at least partial immersion of the at least one ultrasonic energy source into the bath cleaning solution.

19. The method of claim 12, wherein the step of applying comprises at least one ultrasonic energy sources mounted outside the rinsing bath apparatus in ultrasonic energy transfer relationship with the bath cleaning solution.

20. The method of claim 19, wherein the at least one ultrasonic energy source is mounted on at least one of a bottom portion or wall of the rinsing bath apparatus.

21. The method of claim 12, wherein the step of applying comprises at least one ultrasonic energy source comprising ultrasonic frequenics of about 10 kHz to about 1200 kHz.

22. The method of claim 12, wherein the particulates comprise organic particulates.

* * * * *